US008073358B2

(12) United States Patent
Ishii et al.

(10) Patent No.: US 8,073,358 B2
(45) Date of Patent: Dec. 6, 2011

(54) IMAGE FORMING DEVICE AND CARTRIDGE

(75) Inventors: Masahiro Ishii, Nagoya (JP); Fumio Morita, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 12/895,215

(22) Filed: Sep. 30, 2010

(65) Prior Publication Data

US 2011/0020032 A1 Jan. 27, 2011

Related U.S. Application Data

(63) Continuation of application No. 12/034,106, filed on Feb. 20, 2008, now Pat. No. 7,840,154.

(30) Foreign Application Priority Data

Feb. 20, 2007 (JP) ..... 2007-040029
May 7, 2007 (JP) ..... 2007-122706

(51) Int. Cl.
*G03G 15/00* (2006.01)

(52) U.S. Cl. ..... 399/107; 399/90; 399/111; 399/114; 399/125; 399/126

(58) Field of Classification Search ..... 399/12, 399/13, 90, 107, 111, 114, 125, 126, 262
See application file for complete search history.

(56) References Cited

U.S. PATENT DOCUMENTS 5,521,693 A 5/1996 Kojima et al.
5,708,912 A 1/1998 Lee
5,926,666 A * 7/1999 Miura et al. ..... 399/25
5,937,239 A 8/1999 Watanabe et al.
5,956,541 A 9/1999 Hoshika et al.
6,041,203 A 3/2000 Suzuki et al.
6,101,350 A 8/2000 Suzuki et al.
6,351,618 B1 2/2002 Pollocks, Jr.
6,876,826 B2 4/2005 Noda et al.
(Continued)

FOREIGN PATENT DOCUMENTS

JP 04-337758 11/1992
(Continued)

OTHER PUBLICATIONS

Non-Final Office Action in U.S. Appl. No. 12/034,203 dated Jun. 9, 2010.

*Primary Examiner* — David Porta
*Assistant Examiner* — Casey Bryant
(74) *Attorney, Agent, or Firm* — Banner & Witcoff, Ltd.

(57) ABSTRACT

An image forming device is described according to an aspect comprises: a photoconductive drum; a developing roller opposed to the photoconductive drum; a developer container; a cartridge; a second portion; and a second terminal. The cartridge comprises: a cartridge frame; a memory unit; a first portion disposed at an upstream portion in a vicinity of an upstream end in an attachment direction of the cartridge frame; and a first terminal disposed at at least a part of the first portion and electrically connected to the memory unit. The second terminal is disposed at least a part of the second portion to contact with the first terminal and electrically connected to a controller disposed in the main body. One of the first portion and second portion receives the other of the first portion and second portion.

16 Claims, 13 Drawing Sheets

U.S. PATENT DOCUMENTS

| | | | | |
|---|---|---|---|---|
| 7,082,276 | B2 | 7/2006 | Karakama et al. | |
| 7,260,342 | B2 * | 8/2007 | Nishimura | 399/113 |
| 2004/0086286 | A1 * | 5/2004 | Ishii et al. | 399/27 |
| 2005/0019061 | A1 * | 1/2005 | Karakama et al. | 399/111 |
| 2008/0226338 | A1 * | 9/2008 | Ahn et al. | 399/111 |
| 2008/0226342 | A1 * | 9/2008 | Deguchi | 399/119 |

FOREIGN PATENT DOCUMENTS

| | | | |
|---|---|---|---|
| JP | 05-210304 | | 8/1993 |
| JP | 08-211818 | | 8/1996 |
| JP | 10-198146 | | 7/1998 |
| JP | 11-184195 | | 7/1999 |
| JP | 2000-250310 | | 9/2000 |
| JP | 2001-228691 | | 8/2001 |
| JP | 2001-305935 | | 11/2001 |
| JP | 2002-072826 | | 3/2002 |
| JP | 2002-132029 | | 5/2002 |
| JP | 2002-323812 | | 11/2002 |
| JP | 2002-328521 | | 11/2002 |
| JP | 2002-341640 | | 11/2002 |
| JP | 2003-177650 | | 6/2003 |
| JP | 2008-058814 | A | 3/2008 |
| JP | 2008-276139 | A | 11/2008 |

* cited by examiner

IMAGE FORMING DEVICE AND CARTRIDGE

CROSS-REFERENCE TO RELATED APPLICATIONS

This application is a Continuation of co-pending U.S. Application Ser. No. 12/034,106, filed Feb. 20, 2008, which is based upon and claims the benefit of priority from Japanese Patent Application No. 2007-040029 filed on Feb. 20, 2007, and Japanese Patent Application No. 2007-122706 filed on May 7, 2007, the entire contents of which are incorporated herein by reference.

TECHNICAL FIELD

The present invention relates to an image forming device and a cartridge.

BACKGROUND

In general, in image forming devices such as laser printers and digital copiers, a laser beam is applied to a photoconductive member to correspond to data on an image to be printed, thereby forming an electrostatic latent image on the photoconductive member. In the devices, a toner image is formed by supplying a toner to the electrostatic latent image and the toner image is transferred to a sheet and then thermally fixed.

The toner for forming a toner image is generally contained in a cartridge. However, when an erroneous cartridge is attached to the image forming device, a toner image cannot be formed properly, and the image forming device may be damaged. Therefore, in order to prevent the attachment of a erroneous cartridge, a correct cartridge is configured so that a cartridge engaging portion is formed in a cartridge frame so as to normally engage with a main-body engaging portion formed in the image forming device.

A memory device may be attached to the cartridge, for storing information useful for easy replacement or maintenance of a cartridge at a proper time, such as an amount of toner or the number of printable sheets. From the viewpoint of performance or request for a decrease in cost, a contact IC chip may be used as the memory device.

A controller is disposed in the image forming device. In this case, a main-body terminal is provided to electrically connect with the controller, and a cartridge terminal is provided to electrically connect with the memory device. By bringing the main-body terminal and the cartridge terminal into contact with each other, the controller of the image forming device can read the information stored in the memory device to perform a proper control operation. In order to allow the memory device to operate normally, the cartridge terminal and the main-body terminal are necessarily in stable contact with each other. Therefore, for example, JP-A-2003-177650 discloses a mechanism for bringing an electrical contact of the memory device provided on a process cartridge and an electrical contact of the image forming device into contact with each other by attaching the process cartridge to the image forming device and closing an opening and closing cover.

In the above cartridge, since a cartridge engaging portion is disposed on one side of an end portion of the cartridge and a terminal of the memory device is disposed on the other side, the cartridge increases in size and a space in the image forming device for receiving the cartridge increases in size, thereby causing an increase in size of the entire device.

In addition, it is necessary to provide the image forming device with a main-body engaging portion corresponding to the cartridge engaging portion and a main-body terminal corresponding to the cartridge terminal, thereby making the configurations of the cartridge and the image forming device complicated.

SUMMARY

One aspect of the invention has an object to provide an image forming device and a cartridge, which can facilitate a detection of attachment of an erroneous cartridge to an image forming device and which can allow a cartridge terminal and a main-body terminal to come in stable contact with each other with a simple configuration.

According to a first aspect of the invention, there is provided an image forming device comprising: a main body; a photoconductive drum; a developing roller opposed to the photoconductive drum; a developer container configured to contain a developer and disposed across the developing roller from the photoconductive drum when viewed from a direction parallel to an axis direction of the developing roller; a cartridge comprising: a cartridge frame having at least the developer container formed therein; a memory unit; a first portion disposed at an upstream portion in a vicinity of an upstream end in an attachment direction of the cartridge frame; and a first terminal disposed at least a part of the first portion and electrically connected to the memory unit; a second portion disposed at the main body; and a second terminal disposed at least a part of the second portion to contact with the first terminal and electrically connected to a controller disposed in the main body, one of the first portion and second portion receives the other of the first portion and second portion.

According to a second aspect of the invention, there is provided a cartridge comprising: a cartridge frame having a developer container configured to contain a developer and an opening configured to supply the developer; a memory unit; a concave portion that is disposed at the cartridge frame in a vicinity of an end portion that is positioned across the developer container from the opening when viewed from a predetermined direction; and a memory terminal disposed at least a part of the concave portion and electrically connected to the memory unit.

DESCRIPTION

First Embodiment

<Entire Configuration of Image Forming Device>

Figure 1:
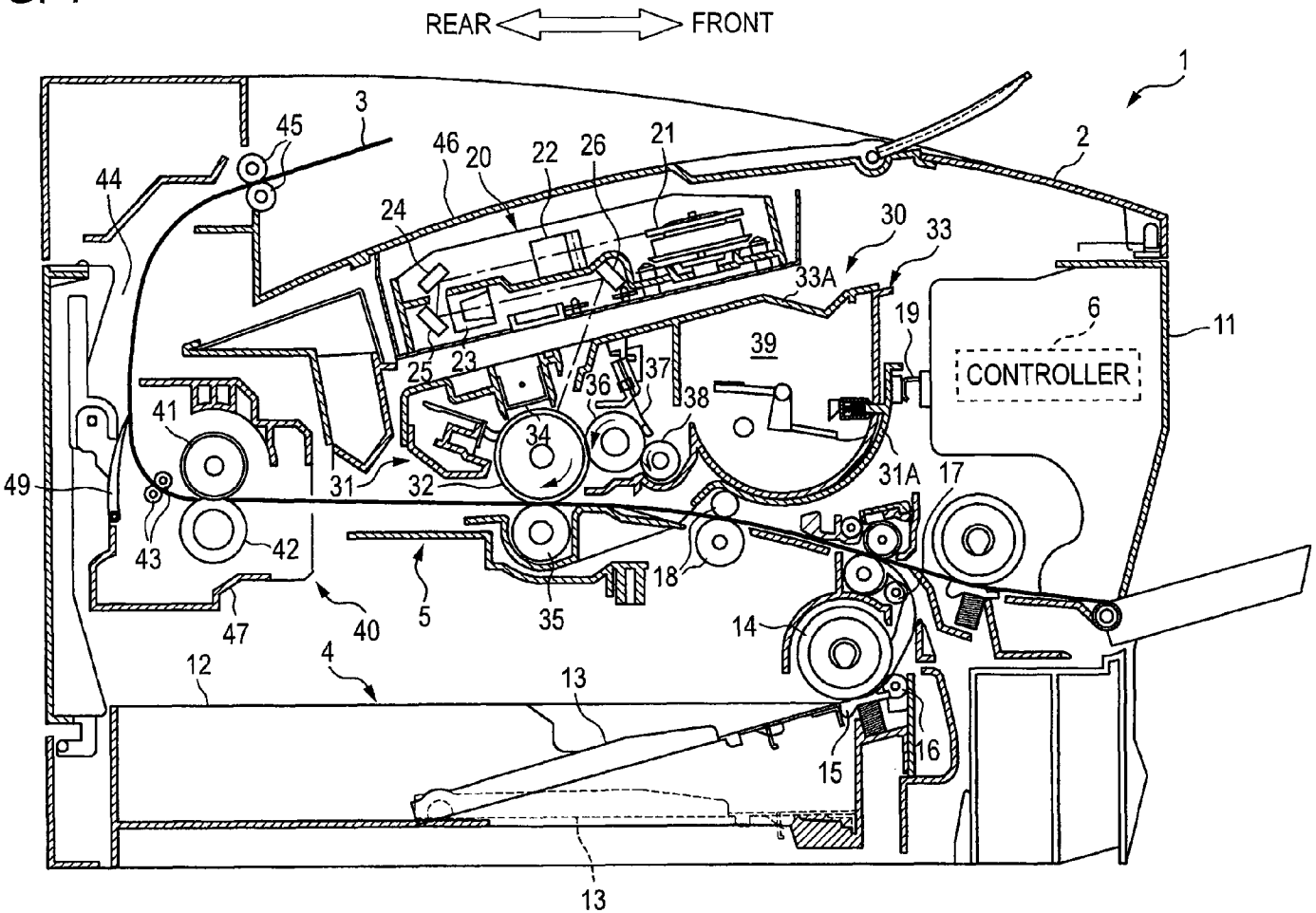
FIG. 1 is a side cross-sectional view illustrating an image forming device according to a first embodiment of the invention.
Figure 2:
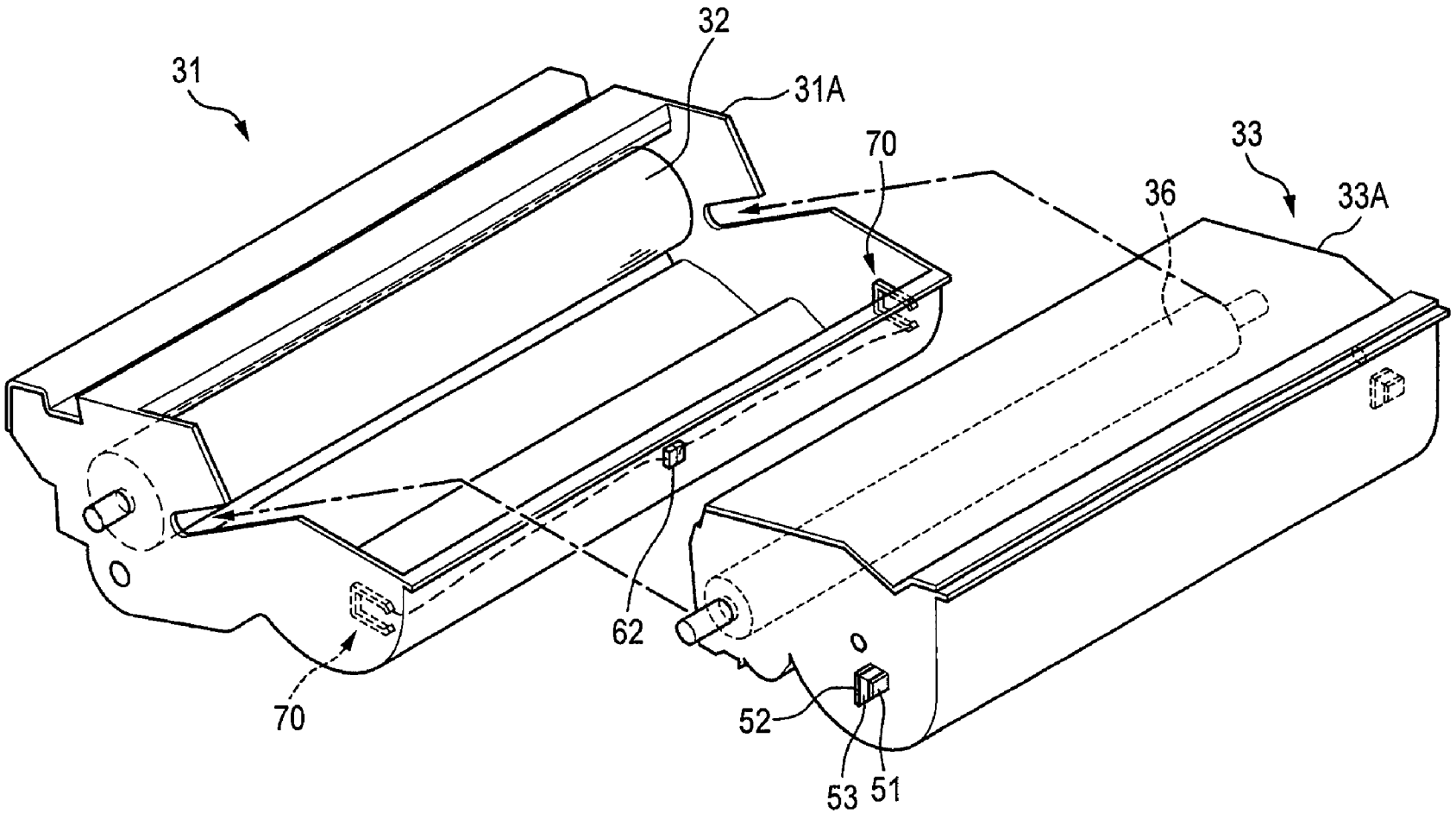
FIG. 2 is a perspective view illustrating a photoconductor cartridge and a developer cartridge as viewed from the front side.

Hereinafter, an embodiment of the invention will be described in detail with reference to the attached drawings. In the drawings, FIG. 1 is a side cross-sectional view illustrating an image forming device and FIG. 2 is a perspective view illustrating a photoconductor cartridge and a developer cartridge. In the following description, the right side in FIG. 1 is defined as a front and the left side is defined as a rear. Also, regarding directions of a process cartridge 30, a photoconductor cartridge 31, and a developer cartridge 33 (which will be described later), the following description refers to directions in a state where they are attached to an image forming device (see FIG. 1).

As shown in FIG. 1, an image forming device 1 includes a feeder unit 4 that feeds a sheet 3 into a main casing 2 (main body) and an image forming unit 5 that forms an image on the fed sheet 3.

A front cover 11 (opening and closing member) that can be freely opened and closed is disposed at a front portion of the main casing 2. A process cartridge 30 to be described later is detachably attached through an opening formed when the front cover 11 is opened.

<Configuration of Feeder Unit>

The feeder unit 4 includes a sheet feeding tray 12 that is detachably attached to the bottom of the main casing 2 and a sheet pressing plate 13 disposed in the sheet feeding tray 12. The feeder unit 4 further includes a feed roller 14 disposed above an end of the sheet feeding tray 12, a feed pad 15, and sheet-powder removing rollers 16 and 17 disposed more downstream in a direction in which the sheet 3 is conveyed than the feed roller 14. The feeder unit 4 includes a registration roller 18 disposed more downstream than the sheet-powder removing rollers 16 and 17.

In the feeder unit 4 having the above-mentioned configuration, the sheet 3 in the sheet feeding tray 12 is made to move to the feed roller 14 by the sheet pressing plate 13. The sheet 3 is sent from the feed roller 14 and the feed pad 15, and then passes through the sheet-powder removing rollers 16, 17 and the registration roller 18. Accordingly, the sheet 3 is conveyed to the image forming unit 5 sheet by sheet.

<Configuration of Image Forming Unit>

The image forming unit 5 includes a scanner unit 20, a process cartridge 30, and a fixing unit 40.

<Configuration of Scanner Unit>

The scanner unit 20 is disposed in an upper portion in the main casing 2 and includes a laser emitting portion (not shown), a polygon mirror 21 that is rotationally driven, lenses 22 and 23, and reflecting mirrors 24, 25, and 26. As indicated by a dotted line, a laser beam based on image data and emitted from the laser emitting portion is subjected to reflection or transmission in the order of the polygon mirror 21, the lens 22, the reflecting mirrors 24 and 25, the lens 23, and the reflecting mirror 26 and is applied to the surface of a photoconductive drum 32 of the process cartridge 30 at a high speed.

<Configuration of Process Cartridge>

The process cartridge 30 is disposed below the scanner unit 20 and is detachably attached to the main casing 2. The process cartridge 30 includes a photoconductor cartridge 31 and a developer cartridge 33 as an example of the cartridge.

<Configuration of Developer Cartridge>

The developer cartridge 33 is detachably attached to a hollow photoconductor frame 31A constituting the outer frame of the photoconductor cartridge 31 (see FIG. 2) and includes a developing roller 36, a thickness regulating blade 37, a supply roller 38, and a toner hopper 39 as an example of the developer container. The developing roller 36 is rotatably supported by a hollow developing frame 33A (cartridge frame) constituting the outer frame of the developer cartridge 33.

A toner (not shown) as an example of the developer contained in the toner hopper 39 is supplied to the developing roller 36 with the rotation in the arrow direction (in the counterclockwise direction) of the supply roller 38. At this time, the toner is frictionally charged positive between the supply roller 38 and the developing roller 36. The toner supplied to the developing roller 36 enters between the thickness regulating blade 37 and the developing roller 36 with the rotation in the arrow direction (in the counterclockwise direction) of the developing roller 36 and is held as a thin layer having a constant thickness on the developing roller 36.

<Configuration of Photoconductor Cartridge>

The photoconductor cartridge 31 includes a photoconductive drum 32, a scorotron charging unit 34, and a transfer roller 35. The photoconductive drum 32 is supported by the photoconductor frame 31A so as to be rotatable in the arrow direction (in the clockwise direction). The drum body of the photoconductive drum 32 is grounded and the surface thereof is formed of a positively-charging photoconductive layer made of polycarbonate.

The scorotron charging unit 34 is disposed above the photoconductive drum 32 with a predetermined gap therebetween so as not to contact with the photoconductive drum 32. The scorotron charting unit 34 is a positively-charging scorotron charger that generates a corona discharged from a charging wire made of tungsten or the like and uniformly charges the surface of the photoconductive drum 32 in a positive polarity.

The transfer roller 35 is disposed below the photoconductive drum 32 so as to contact with the photoconductive drum 32 and is supported by the photoconductor frame 31A so as to be rotatable in the arrow direction (in the counterclockwise direction). In the transfer roller 35, a metal roller shaft is coated with a conductive rubber material. A transfer bias is applied to the transfer roller 35 by static current control at the time of transfer.

In the photoconductor cartridge 31 having the above-mentioned configuration, the surface of the photoconductive drum 32 is positively charged by the scorotron charging unit 34 and then is exposed by means of high-speed scanning of a laser beam from the scanner unit 20. Accordingly, the potential of the exposed portion is lowered to form an electrostatic latent image based on image data.

Here, the "electrostatic latent image" means the exposed portion of which the potential is lowered by means of the exposure to the laser beam, on the surface of the photoconductive drum 32 uniformly charged in a positive polarity.

Next, when the toner held on the developing roller 36 comes in contact with the photoconductive drum 32 with the rotation of the developing roller 36, the toner is supplied to the electrostatic latent image formed on the surface of the photoconductive drum 32. In this way, the toner is selectively held on the surface of the photoconductive drum 32 and is thus visualized, thereby forming a toner image by means of a reversal development.

Thereafter, the photoconductive drum 32 and the transfer roller 35 are rotationally driven to convey the sheet 3. By conveying the sheet 3 between the photoconductive drum 32 and the transfer roller 35, a toner image held on the surface of the photoconductive drum 32 is transferred to the sheet 3.

<Configuration of Fixing Unit>

The fixing unit 40 is disposed on the downstream side of the process cartridge 30 and includes a heating roller 41, a pressing roller 42 that is disposed to be opposite the heating roller 41 so as to press the heating roller 41, and a pair of conveying roller 43 disposed more downstream than the heating roller 41 and the pressing roller 42.

In the fixing unit 40 having the above-mentioned configuration, the toner transferred to the sheet 3 is thermally fixed while the sheet 3 passes between the heating roller 41 and the pressing roller 42 and thereafter, the sheet 3 is conveyed to a sheet discharging path 44 by the conveying rollers 43 and a flapper 49. The sheet 3 sent to the sheet discharging path 44 is discharged to a sheet discharging tray 46 by the discharge roller 45. A part of the rear portion of the main casing 2 is formed of a cover that is opened and closed to expose or cover the fixing unit 40.

<Configuration of Pressing Member>

Figure 3:
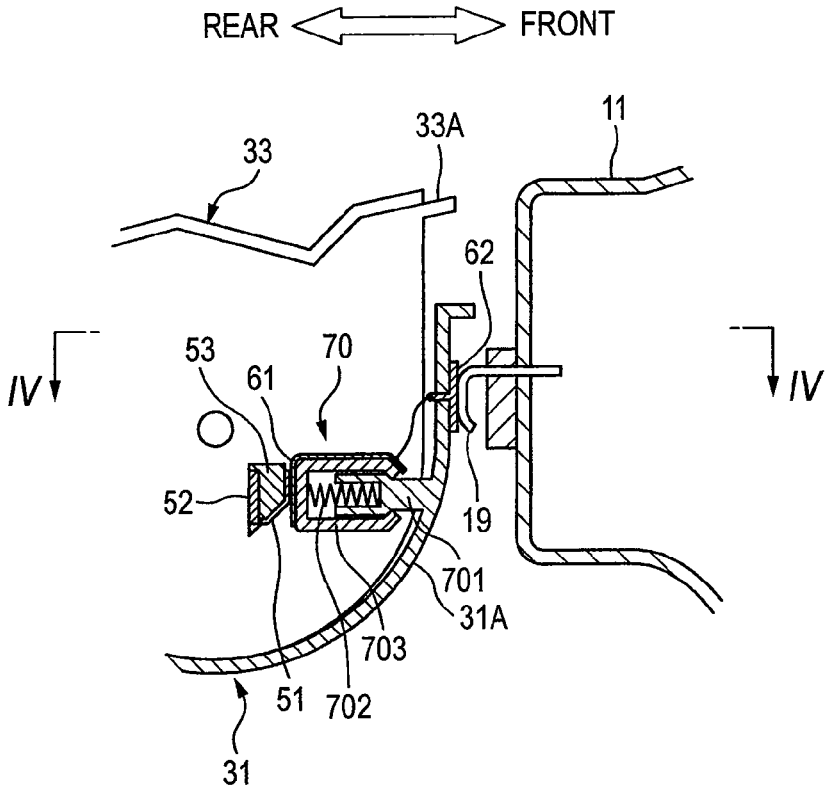
FIG. 3 is a side cross-sectional view illustrating a front portion of a process cartridge and a rear portion of a front cover in a state where the process cartridge is attached to a main casing and the front cover is closed.
Figure 4:
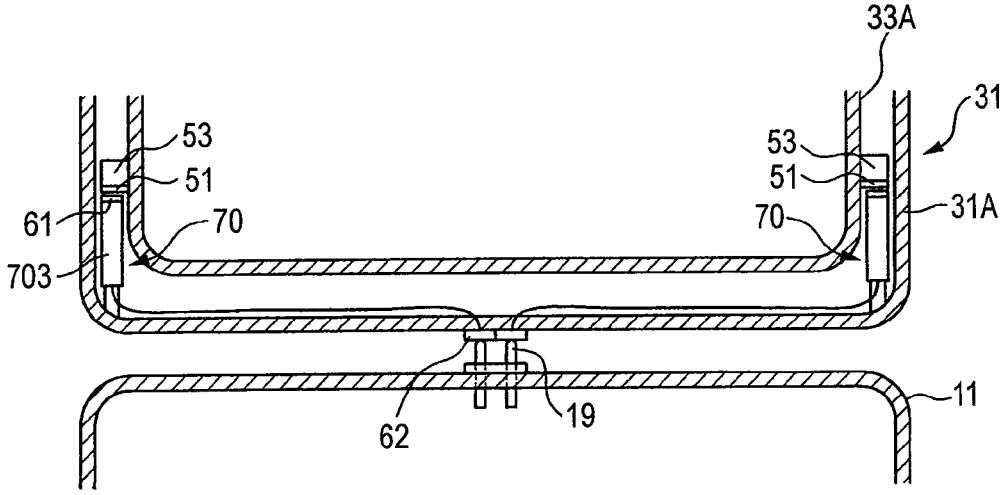
FIG. 4 is a cross-sectional view taken along Line IV-IV of FIG. 3, which shows a state where a developing-frame terminal is connected to a main-body terminal.

FIG. 3 is a side cross-sectional view illustrating a front portion of a process cartridge and a rear portion of a front cover in a state where the process cartridge is attached to a main casing and the front cover 11 is closed. FIG. 4 is a cross-sectional view taken along Line IV-IV of FIG. 3, which illustrates a state where a developing-frame terminal comes in contact with a main-body terminal.

As shown in FIGS. 3 and 4, pressing members 70 are disposed at plural positions of the photoconductor frame 31A in an axis direction of the developing roller 36, that is, at two positions in the vicinity of the inside of both side walls of the photoconductor frame 31A. The pressing members 70 are symmetrically disposed with respect to a plane passing through the center position in the axis direction of the developing roller 36 and perpendicular to the axis direction. Accordingly, as described later, the developer cartridge 33 is pressed to the photoconductive drum 32 with a force distributed uniformly in the axis direction.

Each pressing member 70 includes a pressing-member supporting portion 701 protruding from the photoconductor frame 31A, a spring 702, and a spring cover 703. The pressing-member supporting portion 701 is formed in a concave shape that extends from the front to the rear and the end is divided into two branches and is spread slightly upward. The spring 702 is attached to the bottom of the concave shape. The spring cover 703 surrounds the end of the pressing-member supporting portion 701 to which the spring 702 is attached and engages with the pressing-member supporting portion 701 so as to be slidable in the anteroposterior direction. A compression coil spring is employed as the spring 702.

<Main-Body Terminal>

As shown in FIG. 3, the inner surface of the front cover 11, that is, the surface opposed to the process cartridge 30, is provided with a main-body terminal 19. The main-body terminal 19 is connected to a controller 6 (an electric circuit) and disposed in the main body. The controller 6 may be disposed at an arbitrary portion in the main body.

<Inner Terminal and Outer Terminal>

The end of each of the spring covers 703 is formed flat and an inner terminal 61 is disposed on the rear surface thereof. An outer terminal 62 is disposed on the front surface of the photoconductor frame 31A, that is, on the outer surface on a side of the front cover 11.

The inner terminals 61 and the outer terminal 62 are electrically connected to each other through a contact of a metal plate or a wire. In the example shown in FIG. 3, the outer terminal 62 is exposed partially from the hole formed in the front wall of the photoconductor frame 31A to the inside of the photoconductor frame 31A and the exposed portion is connected to the inner terminals 61 through wires.

The outer terminal 62 is disposed to come in contact with the main-body terminal 19. In the example shown in FIG. 4, the main-body terminal 19 comes in contact with the outer terminal 62, in a state where the process cartridge 30 is attached to the main casing 2 and the front cover 11 is closed.

[<Developing-Frame Terminal>

As shown in FIG. 3, memory units 52 and developing-frame terminals 51 are disposed on the outer surface of the developing frame 33A. The number of memory units 52 may be arbitrary.

The developing-frame terminals 51 are respectively electrically connected to the memory units 52 through the contacts of metal plates or wires. In the example shown in FIG. 3, the memory units 52 are respectively disposed on the rear surfaces of prism-shaped protrusions 53. Each of the prism-shaped protrusions 53 protrudes externally from the side surface of the developing frame 33A. The developing-frame terminals 51 are respectively disposed on the front surfaces of the prism-shaped protrusions 53. The developing-frame terminals 51 are drawn into the lower sides of the protrusions 53 and are electrically connected to the memory units 52, respectively.

Each of the protrusion 53 has an inclined surface of which the lower side goes up toward the front. When the developer cartridge 33 is pushed into the photoconductor frame 31A from the upside, the inclined surfaces enter the lower sides while contracting the pressing members 70.

Each of the developing-frame terminals 51 is disposed at a position opposed to the inner terminal 61 in a state where the developer cartridge 33 is attached to the photoconductor frame 31A. More specifically, each of the developing-frame terminals 51 is disposed to come in contact with the respective one of inner terminals 61 at a position which is closer to the photoconductive drum 32 than the position of the respective one of inner terminals 61 when the respective one of springs 702 is the shortest and more distant from the photoconductive drum 32 than the position of the respective one of inner terminals 61 when the respective one of springs 702 is not pressed.

Operations of the photoconductor cartridge 31, the developer cartridge 33, and the image forming device 1 will be described.

The developer cartridge 33 shown in FIG. 2 is attached to the photoconductor frame 31A to constitute the process cartridge 30.

When the developer cartridge 33 is attached to the photoconductor frame 31A, the springs 702 of the pressing members 70 disposed at plural positions inside the photoconductor frame 31A are pressed to the protrusions 53 disposed at plural positions outside the developing frame 33A and are contracted.

As shown in FIG. 3, when the developer cartridge 33 is completely attached to the photoconductor frame 31A, the expanding pressure of the springs 702 of the pressing members 70 is always applied to the protrusions 53 and thus the pressing force toward the photoconductive drum 32 is applied to the developing frame 33A (pressing operation). By means of the pressing operation, the developing roller 36 supported by the developing frame 33A is pressed to and comes in contact with the photoconductive drum 32 (pressed state). Since the pressing members 70 are disposed symmetrically at two positions of the photoconductor frame 31A in the axis direction of the developing roller 36, the developing roller 36 is pressed to the photoconductive drum 32 uniformly in the axis direction.

By means of the pressing operation, the developing roller 36 is pressed to the photoconductive drum 32 and the developing-frame terminals 51 disposed at the protrusions 53 come in contact with the inner terminals 61 disposed on the surfaces of the spring covers 703 of the pressing members 70.

When the front cover 11 is opened and the process cartridge 30 is attached to the main casing 2 through the opening and thereafter the front cover 11 is closed, as shown in FIGS. 3 and 4, the main-body terminal 19 disposed at the front cover 11 comes in contact with the outer terminal 62 disposed at the outer front portion of the photoconductor frame 31A.

In the pressed state, the memory units 52 are connected to the controller 6 of the main body through the developing-frame terminals 51, the inner terminals 61, the outer terminal 62, and the main-body terminal 19.

In the image forming device 1 according to this embodiment, since the inner terminals 61 are respectively disposed at the pressing members 70, a simple configuration is obtained. The inner terminals 61 disposed at the pressing members 70 respectively come in contact with the developing-frame terminals 51 and the pressing members 70 press the developing frame 33A to the photoconductive drum 32, thereby matching a pressing position for pressing the developing roller 36 to the photoconductive drum 32 with an electrical connection position for the memory units 52.

Since the contact pressure when the main-body terminal 19 comes in contact with the outer terminal 62 is relatively small and acts on the entire process cartridge, it does not prevent the pressing members 70 from uniformly pressing the developing roller 36 to the photoconductive drum 32.

Second Embodiment

The basic configuration of an image forming device according to a second embodiment of the invention is the same as the first embodiment and thus only different points are described.

Figure 5:
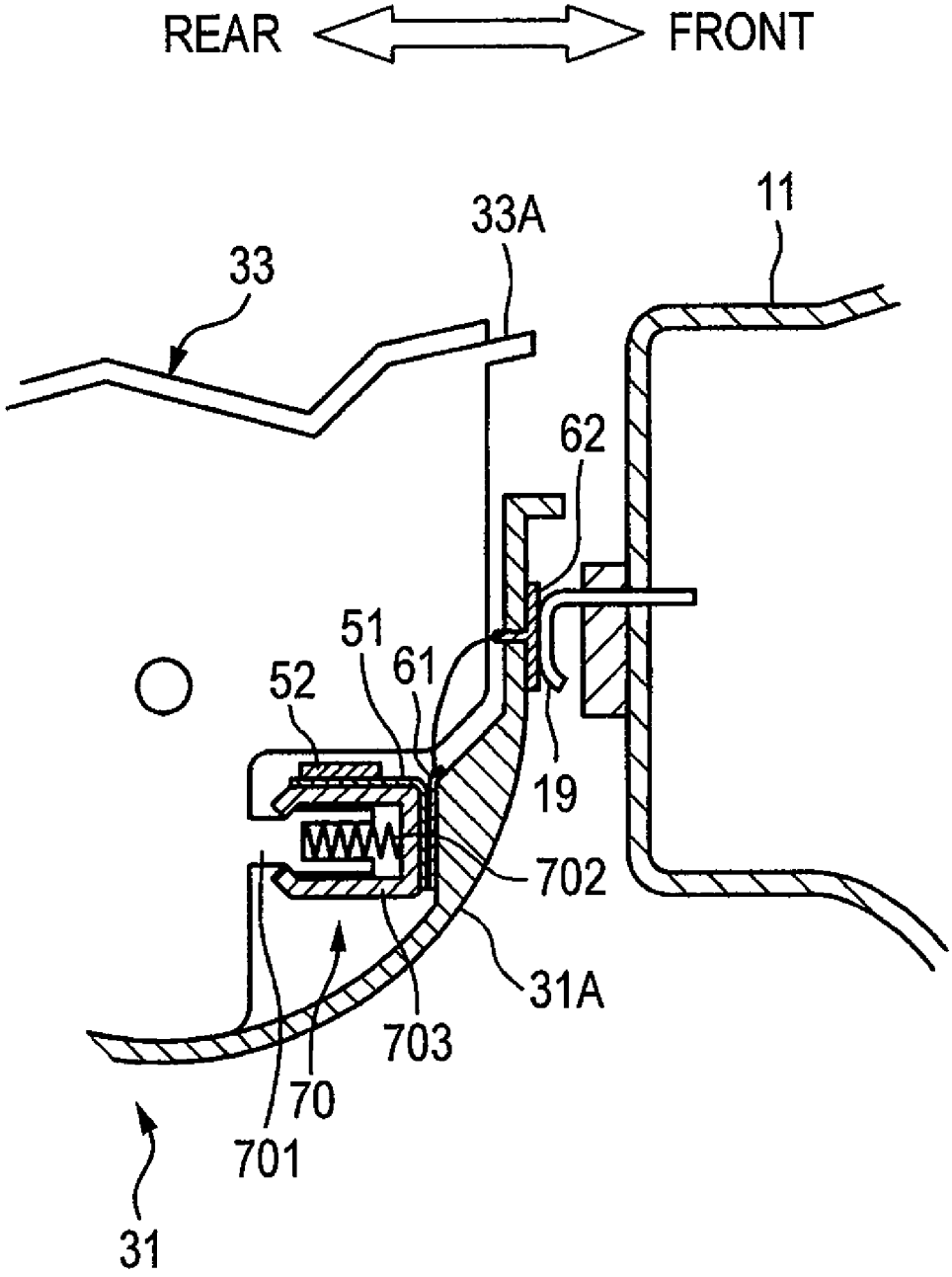
FIG. 5 is a side cross-sectional view illustrating the front portion of the process cartridge and the rear portion of the front cover in a state where the process cartridge is attached to the main casing and the front cover is closed according to a second embodiment.

FIG. 5 is a side cross-sectional view illustrating a front portion of a process cartridge and a rear portion of a front cover in a state where the process cartridge is attached to the main casing and the front cover is closed.

<Arrangement of Pressing Members>

As shown in FIG. 5, each pressing member 70 includes a pressing-member supporting portion 701, a spring 702, and a spring cover 703, similarly to the first embodiment.

The pressing members 70 are disposed symmetrically at two positions outside both side walls of the developing frame 33A (only one position is shown).

<Developing-Frame Terminal>

The end of the spring cover 703 of each pressing member 70 is formed flat, and each of developing-frame terminals 51 is disposed on the outer (front) surface thereof. Each of the memory units 52 is disposed at the pressing member 70 as a part of the developing frame 33A. The memory units 52 are electrically connected to the developing-frame terminal 51.

<Inner Terminal and Outer Terminal>

As shown in FIG. 5, the inner terminals 61 are disposed on the inner surface of the front wall of the photoconductor frame 31A so as to respectively come in contact with the developing-frame terminals 51 in a state where the developer cartridge 33 is attached to the photoconductor frame 31A.

The outer terminal 62 is disposed on the outer surface of the photoconductor frame 31A and the inner terminals 61 and the outer terminal 62 are electrically connected to each other through the contact of a metal plate or a wire. In the example shown in FIG. 5, the outer terminal 62 is exposed partially from the hole formed in the photoconductor frame 31A to the inside of the photoconductor frame 31A and the exposed portion of the outer terminal 62 is connected to the inner terminals 61 through wires.

The outer terminal 62 is disposed to come in contact with the main-body terminal 19. In the example shown in FIG. 5, the main-body terminal 19 comes in contact with the outer terminal 62, in a state where the photoconductor cartridge 31 is attached to the main casing 2 and the front cover 11 is closed.

The main-body terminal 71 serves as an external electric contact of the outer terminal 62.

The developing-frame terminals 51 are disposed at a position where the developer cartridge 33 can be pressed to the photoconductive drum 32 with the expanding pressure of the springs 702 of the pressing members 70 while coming in contact with the inner terminals 61, in a state where the developer cartridge 33 is attached to the photoconductor frame 31A. That is, each of the developing-frame terminals 51 is disposed to come in contact with the respective one of inner terminals 61 at a position which is more distant from the photoconductive drum 32 than the position of the respective one of inner terminals 61 when the respective one of springs 702 is the shortest and closer to the photoconductive drum 32 than the position of the respective one of inner terminals 61 when the respective one of springs 702 is not pressed.

The operations of the photoconductor cartridge 31, the developer cartridge 33, and the image forming device 1 are basically equal to those of the first embodiment, except that the pressing members 70 are disposed at the developing frame 33A and the directions of the pressing members 70 are inverted.

When the developer cartridge 33 is attached to the photoconductor frame 31A, the springs 702 of the pressing members 70 disposed at the plural positions outside the developing frame 33A are pressed to the inner terminals 61 disposed at plural positions inside the photoconductor frame 31A and are contracted.

As shown in FIG. 5, when the developer cartridge 33 is completely attached to the photoconductor frame 31A, the expanding pressure of the springs 702 of the pressing members 70 is always applied to the inner terminals 61. The expanding pressure acts in a direction in which the developing frame 33A is pressed to the photoconductive drum 32 (pressing operation). By means of the pressing operation, the developing roller 36 supported by the developing frame 33A is pressed to the photoconductive drum 32 and comes in contact therewith (pressed state). Since the pressing members 70 are disposed symmetrically at the plural positions of the developing frame 33A in the axis direction of the developing roller 36, the developing roller 36 is pressed to the photoconductive drum 32 uniformly in the axis direction.

In the image forming device 1 according to this embodiment, since the developing-frame terminals 51 are disposed at the pressing members 70, a simple and compact configuration is obtained. Since the developing-frame terminals 51 disposed at the pressing members 70 come in contact with the inner terminals 61 and presses the developing frame 33A to the photoconductive drum 32, it is possible to match the pressing positions with the electrical connection positions. Since the contact pressure when the main-body terminal 19 comes in contact with the outer terminal 62 is relatively small and acts on the entire process cartridge, it does not prevent the pressing members 70 from uniformly pressing the developing roller 36 to the photoconductive drum 32.

Third Embodiment

The basic configurations of an image forming device according to a third embodiment of the invention are the same as the first embodiment and thus only different points are described below.

Figure 6:
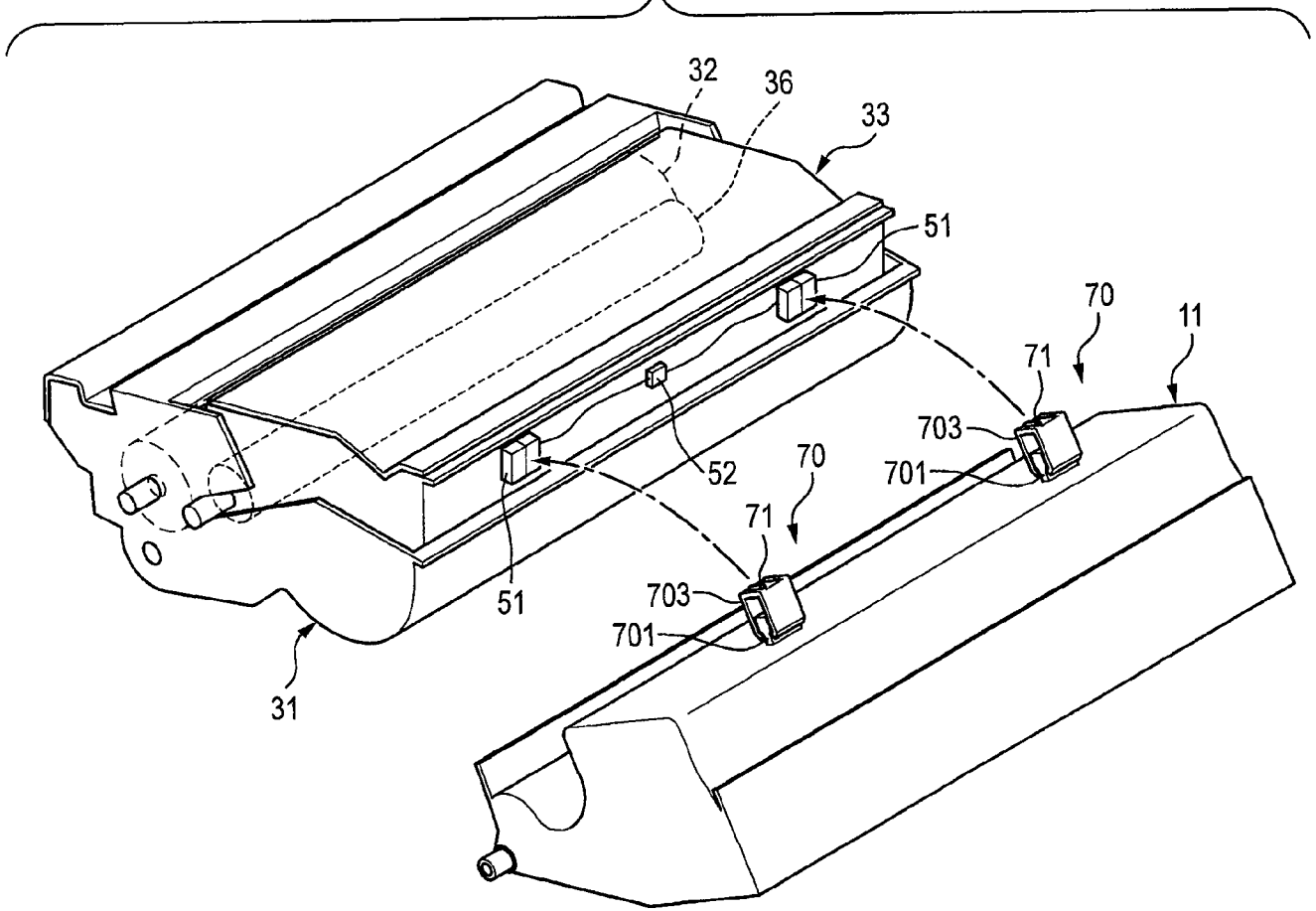
FIG. 6 is a perspective view illustrating a positional relation between the front cover and the process cartridge according to a third embodiment.
Figure 7:
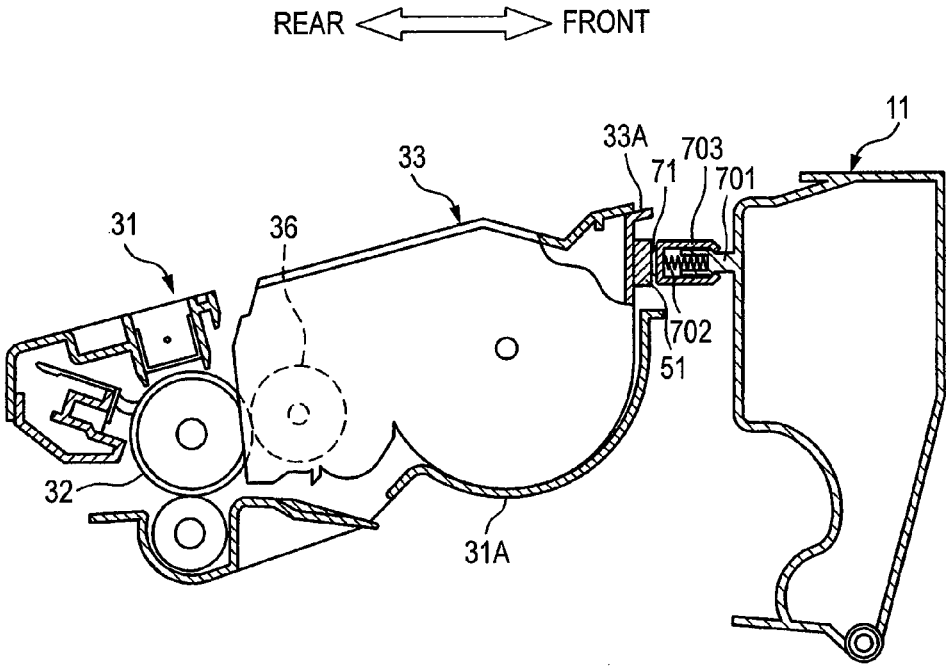
FIG. 7 is a side cross-sectional view illustrating the front portion of the process cartridge and the rear portion of the front cover in a state where the process cartridge is attached to the main casing and the front cover is closed.

FIG. 6 is a perspective view illustrating a positional relation between the front cover 11 and the process cartridge 30. FIG. 7 is a side cross-sectional view illustrating the process cartridge 30 and the front cover 11 in a state where the process cartridge 30 is attached to the main casing 2 and the front cover 11 is closed.

In this embodiment, the photoconductive drum 32 may be disposed in the photoconductor frame 31A or the photoconductor frame 31A may not be provided.

<Pressing Members>

The configuration of the pressing members 70 is the same as the first and second embodiments and thus the arrangement of the pressing members are described.

As shown in FIGS. 6 and 7, the pressing members 70 are disposed on the inner surface of the front cover 11, that is, the surface opposed to the process cartridge 30. The pressing members 70 are disposed at plural positions in the axis direction of the developing roller 36.

As shown in FIG. 6, it is preferable that the pressing members 70 are disposed at plural positions to be symmetric with respect to a plane passing through the center position in the axis direction of the developing roller 36 and perpendicular to the axis direction.

<Main-Body Terminal>

The ends of the spring covers 703 of the pressing members 70 are formed flat, and the main-body terminals 71 are respectively disposed on the flat surfaces to protrude therefrom. The main-body terminals 71 are electrically connected to the controller 6 disposed in the main body.

<Developing-Frame Terminal>

As shown in FIGS. 6 and 7, the developing-frame terminals 51 are disposed at positions, which are exposed from the photoconductor frame 31A when it is attached to the photoconductor frame 31A, on the outer surface of the front portion of the developing frame 33A. As shown in FIGS. 6 and 7, the developing-frame terminals 51 are disposed at positions where they come in contact with the main-body terminals 71 disposed at the spring covers 703 of the pressing members 70, in the state where the front cover 11 is closed.

The developing-frame terminals 51 are electrically connected to the memory unit 52 disposed on the front surface of the developing frame 33A through wires.

Operations of the image forming device 1 having the above-mentioned configuration will be described.

The developer cartridge 33 is attached to the photoconductor frame 31A and the resultant structure is attached to the main body of the image forming device 1. When the front cover 11 is closed, the pressing members 70 come in contact with the developing-frame terminals 51. Then, the springs 702 of the pressing members 70 are pressed and contracted by the developing-frame terminals 51.

As shown in FIG. 7, in the state where the front cover 11 is closed, the expanding pressure of the springs 702 of the pressing members 70 is always applied to the developing-frame terminals 51 and a pressing force toward the photoconductive drum 32 is applied to the developing frame 33A. By means of the pressing force, the developing roller 36 supported by the developing frame 33A is pressed to the photoconductive drum 32 and comes in contact therewith (pressed state). Since the pressing members 70 are disposed at plural positions of the front cover 11 in the axis direction of the developing roller 36 and applies the pressing force thereto, the developing roller 36 is pressed to the photoconductive drum 32 uniformly in the axis direction.

In this pressed state, since the developing-frame terminals 51 come in contact with the main-body terminals 71 disposed on the surfaces of the spring covers 703 of the pressing members 70, the memory unit 52 is connected to the controller 6 disposed in the main body through the developing-frame terminals 51 and the main-body terminals 71.

In the image forming device 1 according to this embodiment, since the main-body terminals 71 are disposed at the pressing members 70, a simple configuration is obtained. Since the main-body terminals 71 disposed at the pressing members 70 come in contact with the developing-frame terminals 51 and press the developing frame 33A to the photoconductive drum 32, it is possible to match the pressing positions with the electrical connection positions, thereby not affecting the pressing force of the developing roller 36 supported by the developing frame 33A to the photoconductive drum 32.

Fourth Embodiment

Figure 8:
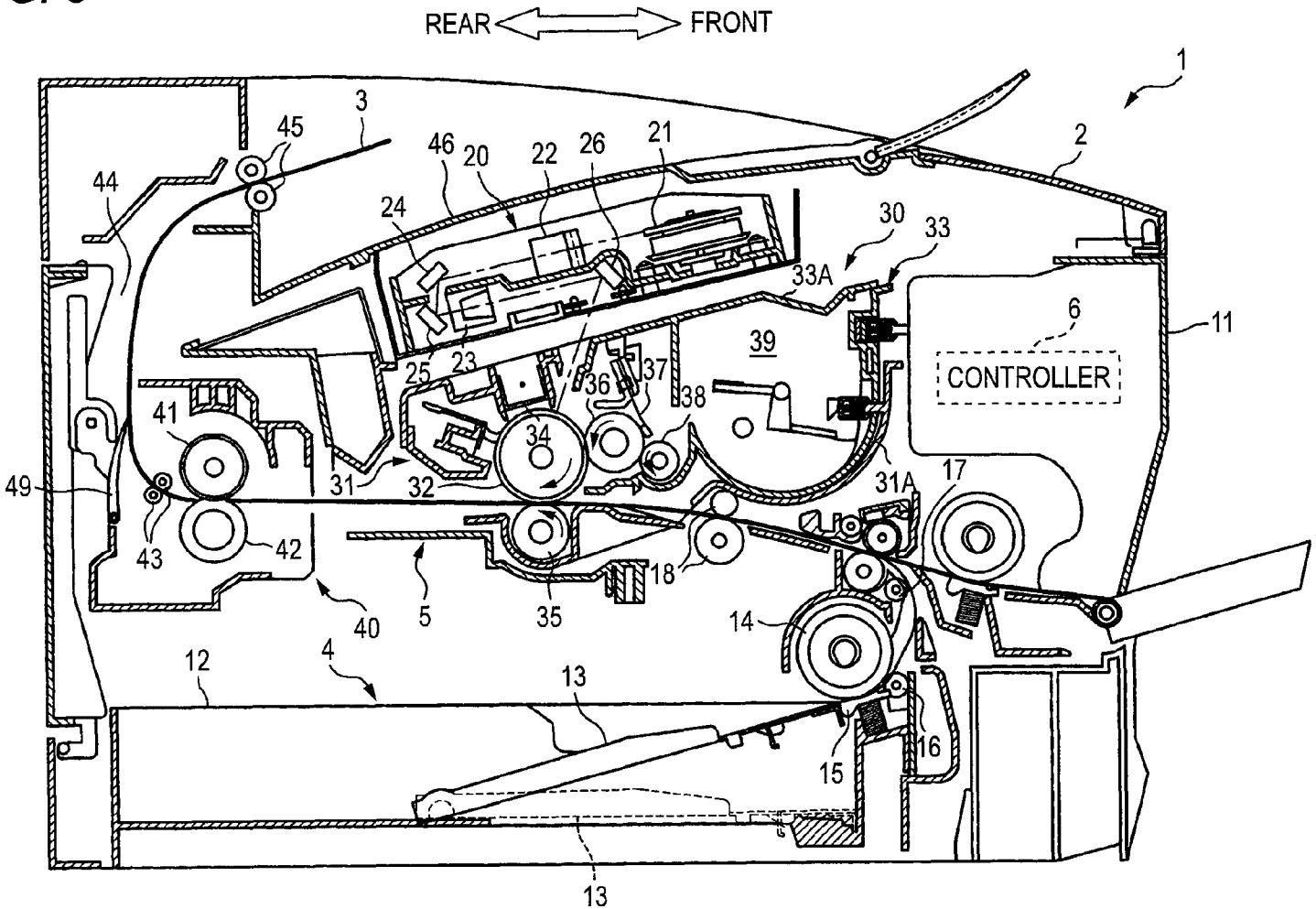
FIG. 8 is a side cross-sectional view illustrating an image forming device according to a fourth embodiment of the invention.

The basic configuration of an image forming device according to a fourth embodiment of the invention is similar to the first embodiment and thus only different points are described. FIG. 8 is a side cross-sectional view illustrating an image forming device and FIG. 9 is a perspective view illustrating a photoconductor cartridge and a developer cartridge, according to a fourth embodiment of the invention.

<Configuration of Pressing Member>

Figure 10:
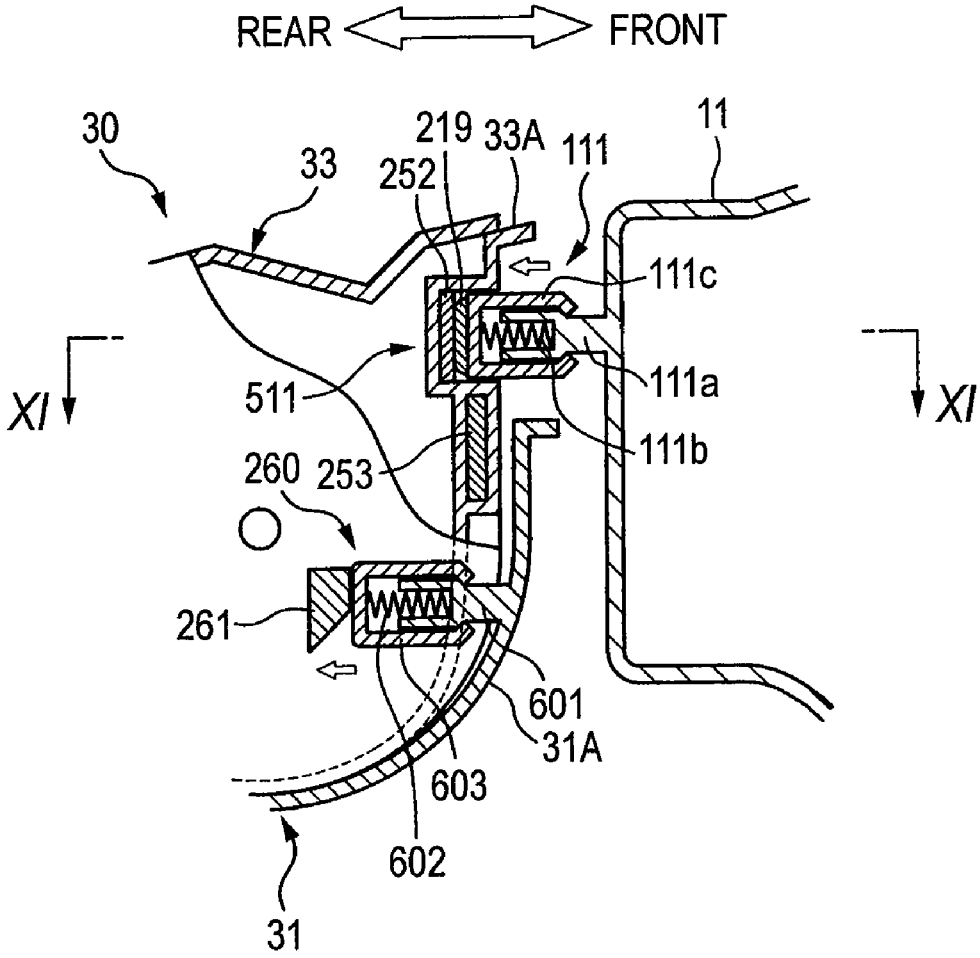
FIG. 10 is a side cross-sectional view illustrating a front portion of a process cartridge and a rear portion of a front cover in a state where the process cartridge is attached to a main casing and the front cover is closed.
Figure 11:
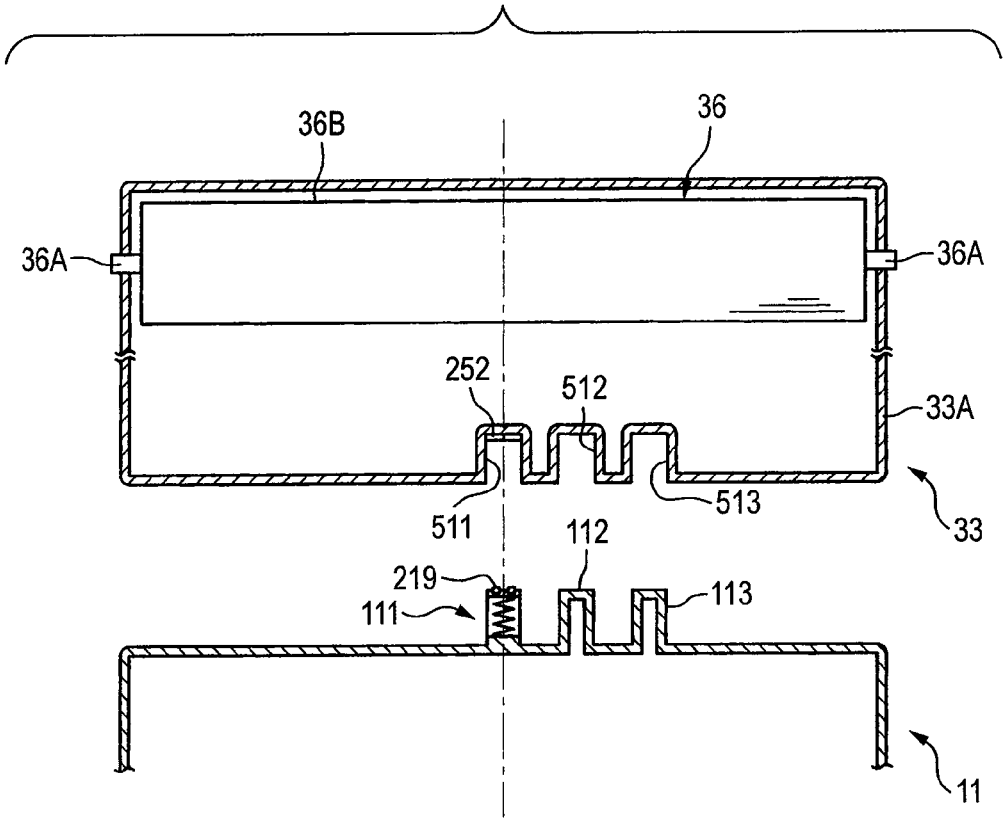
FIG. 11 is a cross-sectional view taken along Line XI-XI of FIG. 10, which shows an arrangement of a developing-frame engaging portion, a developing-frame terminal, a main-body engaging portion, and a main-body terminal.

FIG. 10 is a side cross-sectional view illustrating a front portion of the process cartridge and a rear portion of the front cover in a state where the process cartridge is attached to the main casing and the front cover is closed. FIG. 11 is a cross-sectional view taken along Line XI-XI of FIG. 10, which shows an arrangement of a developing-frame engaging portion, a developing-frame terminal, a main-body engaging portion, and a main-body terminal.

Figure 9:
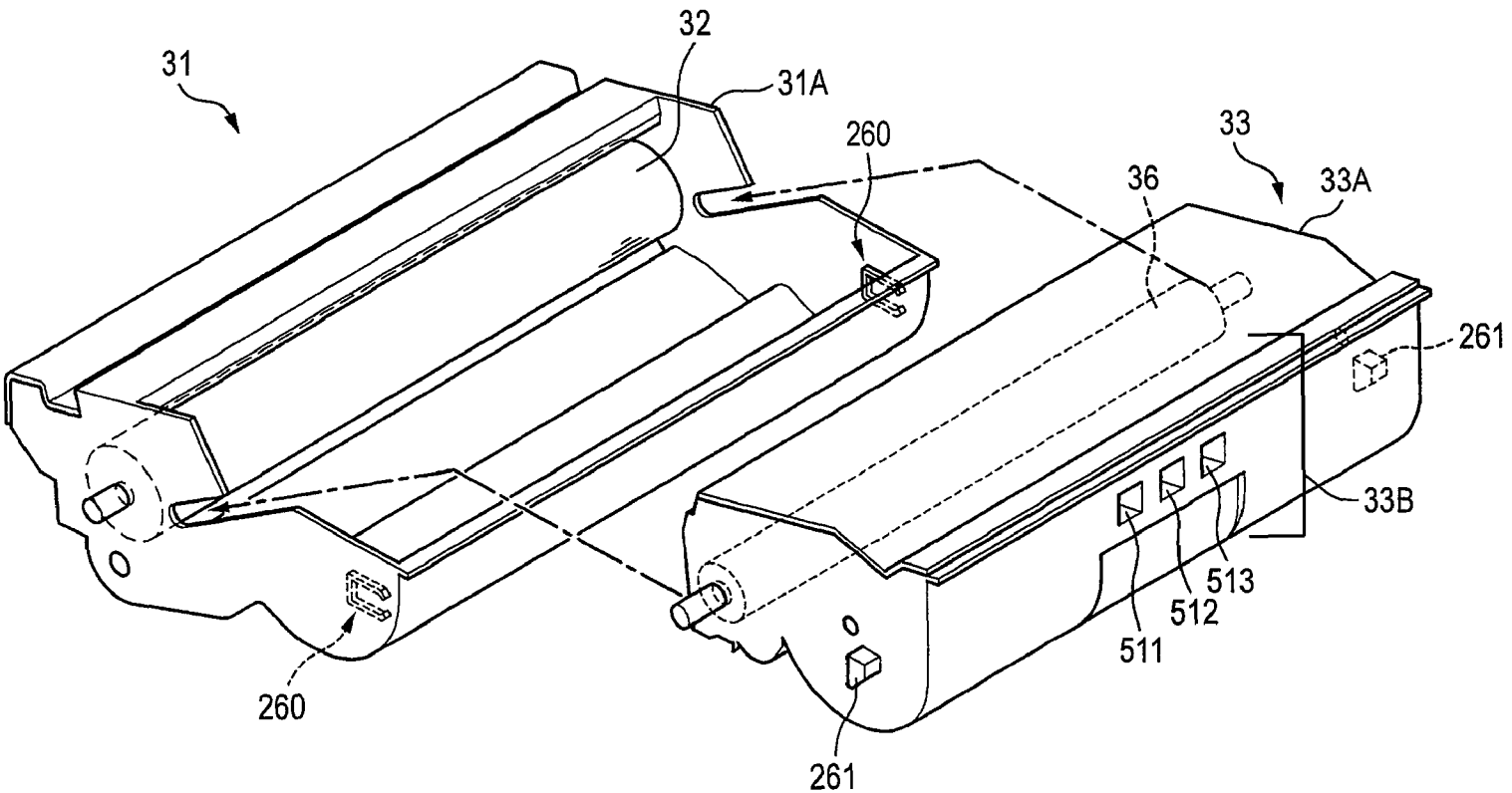
FIG. 9 is a perspective view illustrating a photoconductive cartridge and a developer cartridge.

As shown in FIGS. 8 to 10, pressing members 260 (pressing means) are disposed at two positions (plural positions) of the photoconductor frame 31A in the axis direction of the developing roller 36. Specifically, the pressing members 260 are symmetrically disposed inside the side surfaces (both side walls) of the photoconductor frame 31A perpendicular to the axis of the developing roller 36. Accordingly, as described later, the developer cartridge 33 is pressed to the photoconductive drum 32 with a uniform force in the axis direction.

As shown in FIG. 10, each pressing member 260 has a pressing-member supporting portion 601 protruding from the photoconductor frame 31A, a spring 602, and a spring cover 603. The pressing-member supporting portion 601 has a concave shape that extends from the front to the rear and of which the end is divided into two branches and is slightly spread vertically. The spring 602 is attached to the bottom of the concave shape. The spring cover 603 surrounds the end of the pressing-member supporting portion 601 to which the spring 602 is attached, and engages with the pressing-member supporting portion 601 so as to be slidable in the anteroposterior direction. In this embodiment, a compression coil spring is used as the spring 602.

When the developer cartridge 33 is completely attached to the photoconductor frame 31A, the pressing members 260 come in contact with prism-shaped protrusions 261 protruding outward from both side surfaces of the developing frame 33A in a state where the springs 602 are contracted. The lower surface of each of the protrusions 261 is an inclined face inclined downward and backward from the front side. Accordingly, when the developer cartridge 33 is pushed into the photoconductor frame 31A from the upside, the inclined faces move downward while contracting the springs 602 of the pressing members 260.

<Configuration of Main-Body Engaging Portion and Main-Body Terminal>

As shown in FIGS. 10 and 11, the inner surface of the front cover 11, that is, a surface opposed to the process cartridge 30, is provided with main-body engaging portions 111, 112, and 113 as an example of the second engaging portion. The main-body engaging portion 111 has the same configuration as the pressing member 260 and the main-body engaging portions 112 and 113 are formed convex. A main-body terminal 219 as an example of the second terminal electrically connected to the controller 6 (see FIG. 8) disposed in the main casing 2 is disposed at the end of the main-body engaging portion 111.

The main-body engaging portion 111 includes a supporting portion 111*a* protruding from the front cover 11, a spring 111*b*, and a spring cover 111*c*, which are similar to the pressing-member supporting portion 601, the spring 602, and the spring cover 603 of the pressing member 260 and thus will not be described.

<Configuration of Developing-Frame Engaging Portion and Developing-Frame Terminal>

As shown in FIGS. 10 and 11, concave developing-frame engaging portions 511, 512, and 513 as an example of the first engaging portion (or concave portion) engaging with the main-body engaging portions 111, 112, and 113 are disposed on the outer surface opposed to the front cover 11 of the developing frame 33A. More specifically, the developing-frame engaging portions 511, 512, and 513 are disposed at a grip portion 33B (see FIG. 9) formed at an upstream end in the attaching direction of the developing frame 33A, that is, an end (see FIG. 8) opposite to the position of the developing roller 36 with the toner hopper 39 interposed therebetween. The grip portion 33B is a portion gripped by a user at the time of attaching and detaching the developer cartridge 33 to and from the photoconductive cartridge 31.

The developing-frame engaging portion 511 is disposed at the center in the axis direction of the developing roller 36 and the developing-frame engaging portions 512 and 513 are disposed in parallel on the right side thereof.

Here, the "center in the axis direction of the developing roller 36" means any one of "the center in the axis direction of the rotation shaft 36A", "the center in the axis direction of the roller portion 36B", and "the center in the axis direction of an image forming area of the roller portion 36B", in which the developing roller 36 includes the rotation shaft 36A shown in FIG. 11 and the roller portion 36B surrounding the rotation shaft 36A. Specifically, the engaging portion is preferably disposed at the center in the axis direction of the image forming area of the roller portion 36B.

Here, the main-body engaging portions 111, 112, and 113 are disposed at positions where they engage with the developing-frame engaging portions 511, 512, and 513. Accordingly, when the process cartridge 30 is attached to the main casing 2 and the front cover 11 is closed, the main-body engaging portions and the developing-frame engaging portions engage with each other. Therefore, even when the developer cartridge (not shown) in which the positions of the developing-frame engaging portions are different from the positions of the main-body engaging portions is attached to the main casing 2 and the front cover 11 is closed, the front cover 11 is not closed normally.

A developing-frame terminal 252 as an example of the first terminal (or memory terminal) electrically connected to an IC chip 253 as an example of the memory unit disposed at the developing frame 33A is disposed on the bottom surface of the concave portion of the developing-frame engaging portion 511 disposed at the center in the axis direction of the developing roller 36. The developing-frame terminal 252 comes in contact with the main-body terminal 219 when the main-body engaging portion 111 normally engages with the developing-frame engaging portion 511.

Plural positions of the developing-frame engaging portions can be properly changed. The shapes of the plural developing-frame engaging portions may be equal to each other or may be different from each other. The same is true of the plural main-body engaging portions, so long as they can engage with the corresponding developing-frame engaging portions.

Figure 12:
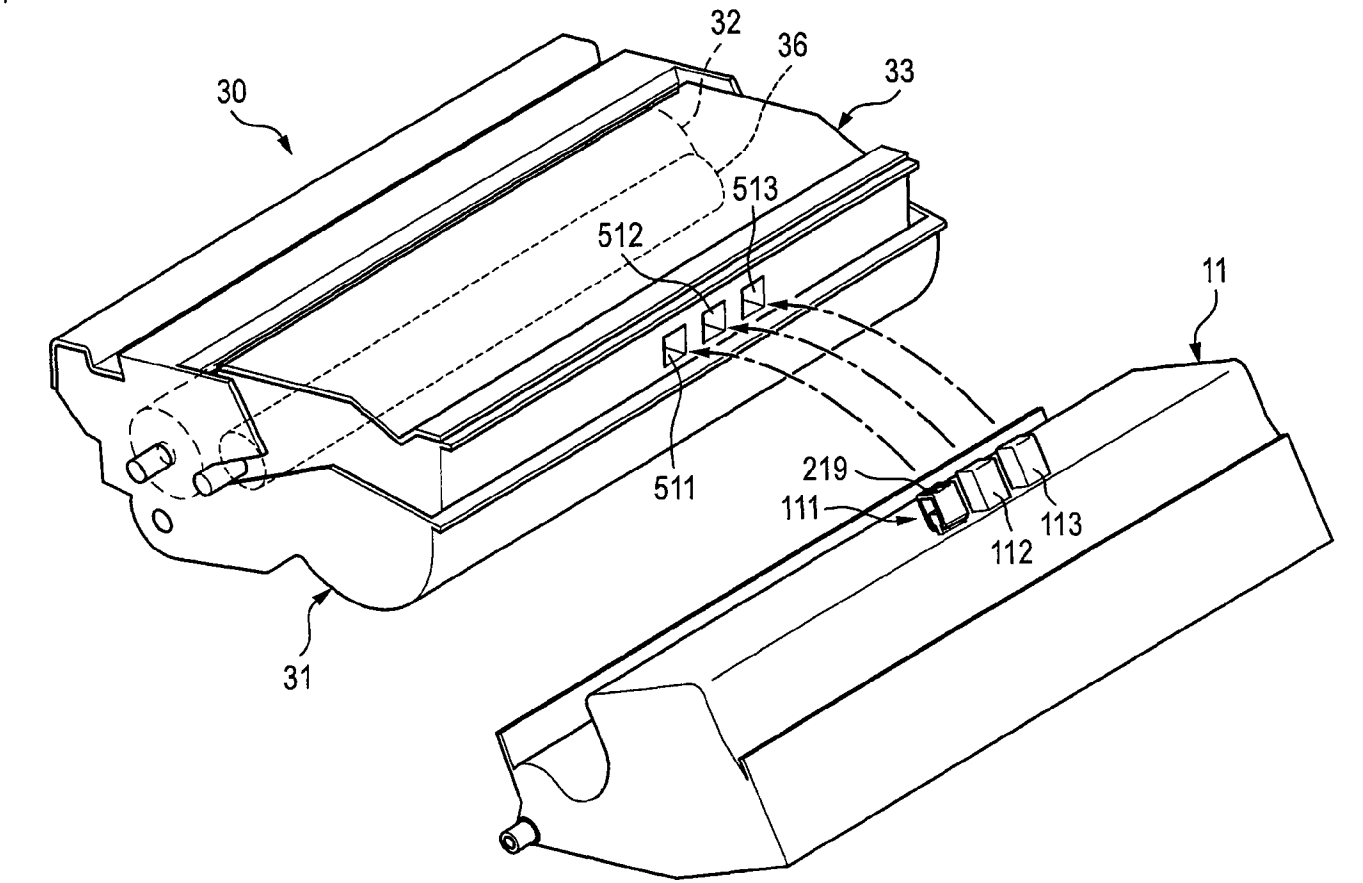
FIG. 12 is a perspective view illustrating a positional relation between the front cover and the process cartridge.

Operations of the photoconductive cartridge 31, the developer cartridge 33, and the image forming device 1 will be described. FIG. 12 is a perspective view illustrating a positional relation between the front cover and the process cartridge.

First, as shown in FIGS. 9 and 12, the developer cartridge 33 is attached to the photoconductor frame 31A to constitute the process cartridge 30. When the developer cartridge 33 is attached to the photoconductor frame 31A, springs 602 of the pressing members 260 disposed at the photoconductor frame 31A are pressed and contracted by protrusions 261 disposed at the developing frame 33A.

As shown in FIG. 10, when the developer cartridge 33 is completely attached to the photoconductor frame 31A, an expanding pressure of the springs 602 of the pressing members 260 is always applied to the protrusions 261. Accordingly, a pressing force toward the photoconductive drum 32 (in the arrow direction in the lower side of FIG. 10) is applied to the developing frame 33A. With this pressing force, the developing roller 36 supported by the developing frame 33A comes in pressing contact with the photoconductive drum 32. Since the pressing members 260 are disposed symmetrically at two positions of the photoconductor frame 31A in the axis direction of the developing roller 36, the developing roller 36 is pressed to the photoconductive drum 32 uniformly in the axis direction.

Next, the front cover 11 is opened, the process cartridge 30 is attached to the main casing 2 through the opening, and then the front cover 11 is closed. As shown in FIGS. 10 to 12, when the front cover 11 is closed, the main-body engaging portions 111, 112, and 113 disposed at the front cover 11 engage with the developing-frame engaging portions 511, 512, and 513 disposed at the developing frame 33A, respectively. When the front cover 11 is normally closed, as shown in FIG. 10, the main-body terminal 219 disposed at the main-body engaging portion 111 comes in contact with the developing-frame terminal 252 disposed at the developing-frame engaging portion 511.

Here, in the state where the developing-frame terminal 252 is in contact with the main-body terminal 219, since the spring 111*b* of the main-body engaging portion 111 is contracted, the expanding pressure thereof is always applied to the bottom (developing-frame terminal 252) of the developing-frame engaging portion 511. Accordingly, since the pressing force acts on the contact portion between the developing-frame terminal 252 and the main-body terminal 219, they can be brought into stable contact with each other.

According to the image forming device 1 of this embodiment, the following advantages can be obtained.

According to the image forming device 1, the developing-frame engaging portion 511 can normally engage with the main-body engaging portion 111, thereby electrically connecting the developing-frame terminal 252 to the main-body terminal 219. Accordingly, it is possible to accomplish the electrical connection between the IC chip 253 and the controller 6 disposed in the main casing 2 with a simple configuration.

According to the image forming device 1, even when the developer cartridge (not shown) having the developing-frame engaging portion not engaging with the main-body engaging portion 111 is attached to the main casing 2 and the front cover 11 could be closed, the developing-frame terminal (not shown) does not come in contact with the main-body terminal 219. Accordingly, for example, the image forming device 1 outputs an error or does not work and thus a user can find out the failure of the image forming device 1, thereby easily finding out the attachment of the erroneous cartridge to the image forming device 1.

According to the image forming device 1, since the developing-frame terminal 252 is disposed on the bottom of the concave portion of the developing-frame engaging portion 511, it is possible to suppress a damage of the developing-frame terminal 252 due to an interference with an other member of the main casing 2 or a damage due to a user's erroneous handling at the time of attachment.

According to the image forming device 1, since the main-body engaging portion 111 is disposed at the front cover 11, the main-body terminal 219 can be electrically connected to the developing-frame terminal 252 only by closing the front cover 11. That is, it is possible to accomplish the electrical connection between the IC chip 253 and the controller 6 of the main casing 2 with a simple configuration.

According to the image forming device 1, since the developing-frame terminal 252 is disposed at an end (an upstream end in the attachment direction of the developing frame 33A) opposite to the developing roller 36 with the toner hopper 39 interposed therebetween, it is possible to reduce an influence on the uniform pressing between the developing roller 36 and the photoconductive drum 32.

That is, since a pressing force acts on the contact portion between the developing-frame terminal 252 and the main-body terminal 219, the pressing force may break a pressing balance of the pressing members 260 and thus the developing roller 36 may not be pressed to the photoconductive drum 32 uniformly in the axis direction. Therefore, in the image forming device 1, by disposing the developing-frame terminal 252 to be opposite to the developing roller 36 with the toner hopper 39 interposed therebetween, the pressing force between the terminals is made to act at a position distant from the developing roller 36, thereby reducing the influence of the pressing force between the terminals.

The ends of the main-body engaging portions 111, 112, and 113 and the bottoms of the concave portions of the developing-frame engaging portions 511, 512, and 513 are designed not to come in contact with each other even when they engage with each other. Accordingly, the engagement of the main-body engaging portions 112 and 113 with the developing-frame engaging portions 512 and 513 does not affect the uniform pressing between the developing roller 36 and the photoconductive drum 32.

According to the image forming device 1, since the main-body terminal 219 comes in contact with the developing-frame terminal 252 in a direction (the arrow direction in the upper side of FIG. 10) parallel to the pressing direction (the arrow direction in the lower side of FIG. 10) of the pressing members 260, it is possible to reduce the influence on the uniform pressing between the developing roller 36 and the photoconductive drum 32.

According to the image forming device 1, since the developing-frame terminal 252 is disposed at the center (indicated by the dotted line in FIG. 11) in the axis direction of the developing roller 36, it is possible to reduce the influence on the uniform pressing between the developing roller 36 and the photoconductive drum 32.

Fifth Embodiment

Next, a fifth embodiment of the invention will be described in detail with reference to the drawings. The fifth embodiment is different from the fourth embodiment, only in a partial configuration of the image forming device 1 according to the fourth embodiment, specifically, positions of the developing-frame terminal and the main-body terminal, and thus this point is mainly described. In the drawings, FIG. 13 is a cross-sectional view illustrating an arrangement of the developing-frame engaging portion, the developing-frame terminal, the main-body engaging portion, and the main-body terminal according to this embodiment.

Figure 13:
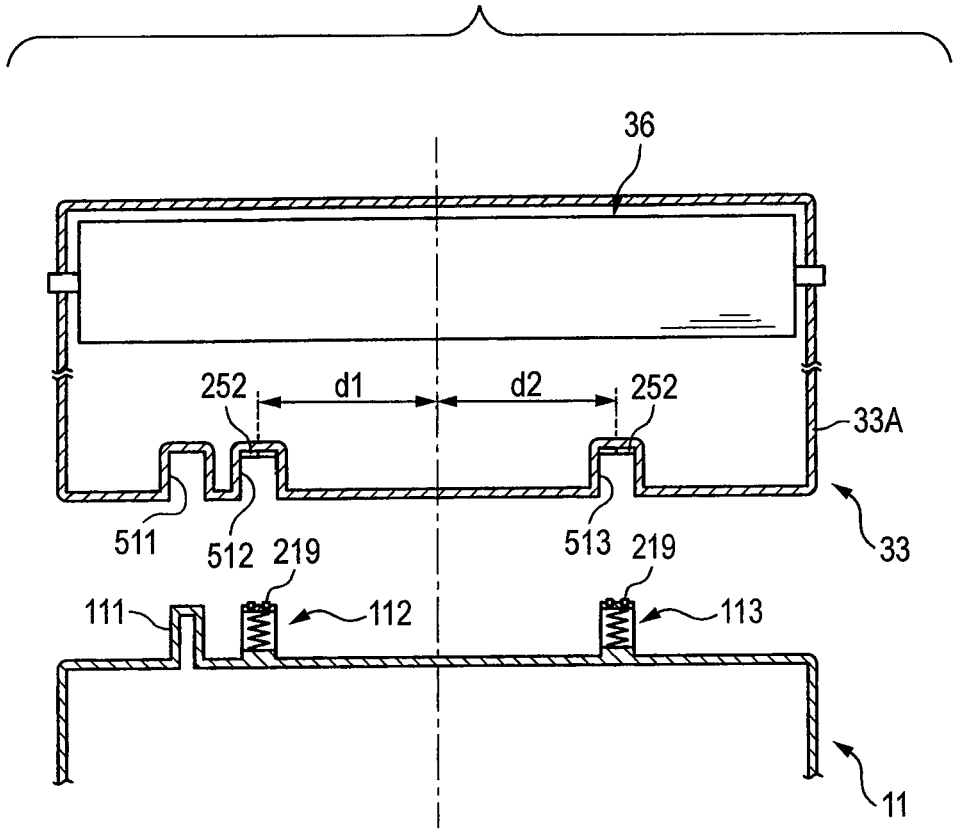
FIG. 13 is a cross-sectional view illustrating an arrangement of a developing-frame engaging portion, a developing-frame terminal, a main-body engaging portion, and a main-body terminal according to a fifth embodiment of the invention.

As shown in FIG. 13, the main-body engaging portions 111, 112, and 113 are disposed on the inner surface of the front cover 11 and the main-body terminals 219 electrically connected to the controller 6 (see FIG. 8) disposed in the main casing 2 are disposed at the ends of the main-body engaging portions 112 and 113. The configurations of the main-body engaging portions 112 and 113 of this embodiment are similar to those of the main-body engaging portion 111 (see FIG. 10) of the fourth embodiment and thus its description is omitted.

The upstream end in the attachment direction of the developing frame 33A, that is, the end (see FIG. 8) opposite to the position of the developing roller 36 with the toner hopper 39 interposed therebetween, is provided with concave developing-frame engaging portions 511, 512, and 513 engaging with the main-body engaging portions 111, 112, and 113. More specifically, the developing-frame engaging portions 511 and 512 are disposed on the left side of the center position (indicated by the dotted line in FIG. 13) in the axis direction of the developing roller 36 and the developing-frame engaging portion 513 is disposed on the right side of the center position in the axis direction of the developing roller 36.

Developing-frame terminals 252 electrically connected to the IC chip 253 (see FIG. 10) are disposed on the bottoms of the concave shapes (concave portions) of the developing-frame engaging portions 512 and 513. Two developing-frame terminals 252 are disposed symmetrically (d1=d2) with respect to the center position in the axis direction of the developing roller 36. When the main-body engaging portions 112 and 113 engage with the developing-frame engaging portions 512 and 513, respectively, the developing-frame terminals 252 come in contact with the main-body terminals 219 in a state where a pressing force acts thereon.

In the image forming device according to this embodiment, since the developing-frame terminals 252 are disposed symmetrically with respect to the center position in the axis direction of the developing roller 36, it is possible to reduce the influence on the uniform pressing between the developing roller 36 and the photoconductive drum 32.

Although the embodiments of the invention have been described, the invention is not limited to the embodiments, but may be properly modified in various forms. For example, in the above-mentioned embodiments, a leaf spring shape is employed as an example of a terminal, the invention is not limited to it, but a pin shape may be employed.

Further, in the embodiments, the pressing members 70 are disposed at two positions, but three or more pressing members may be provided. In this case, by disposing the pressing members to be as symmetric as possible, it is possible to press the developing roller 36 to the photoconductive drum 32 uniformly in the axis direction.

In the embodiments, the terminals are disposed at all the pressing members 70, but the terminals may not be disposed at all the pressing members 70. For example, one terminal may be disposed as an electrical contact only at one pressing member 70.

In the above-mentioned embodiments, a combination of the compression coil spring and the supporting member is employed as an example of the pressing member, but the invention is not limited to it, and any member may be used so long as it can perform the pressing with high precision. That is, the materials or structures may be properly modified without departing from the technical spirit of the invention.

In the embodiments, the photoconductor cartridge are exemplified as a photoconductor unit detachably attached to the image forming device. However, an unexchangeable photoconductor unit may be provided in the image forming apparatus.

In the embodiments, one or two developing-frame terminals 252 are disposed, but the invention is not limited to it, and three or more developing-frame terminals may be disposed. In this case, in order to reduce the influence on the uniform pressing between the developing roller 36 and the photoconductive drum 32, it is preferable that they are disposed symmetrically.

In the embodiments, the developing-frame engaging portions 511, 512, and 513 are formed in a concave shape, but they may be formed in a convex shape or in a combination of a concave shape and a convex shape. The shape of the main-body engaging portions may be properly changed so long as they can engage with the corresponding developing-frame engaging portions. In addition, the developing-frame engaging portion and the main-body engaging portion may not be tightly engaged with each other, and one of the developing-frame engaging portion and the main-body engaging portion may have a configuration to receive the other thereof. For example, one engagement portion of the concave shape may be formed to receive a plurality of engagement portions of convex shape.

In the embodiments, three developing-frame engaging portions are provided, but the invention is not limited to it and one or two developing-frame engaging portions may be provided, or four or more developing-frame engaging portions may be provided. That is, at least one developing-frame engaging portion is enough and when the number of the developing-frame engaging portions is plural, the number can be determined properly. The same is true of the main-body engaging portions, so long as they can engage with the corresponding developing-frame engaging portions.

In the embodiment (fourth embodiment), the supporting portion 111*a* protruding from the front cover 11, the spring 111*b*, and the spring cover 111*c* are combined as the main-body engaging portion 111, but the invention is not limited to the configuration. That is, any member may be used so long as it can bring the main-body terminal 219 into precise contact with the developing-frame terminal 252.

In the embodiments, the pressing members 260 are disposed inside the side surface of the photoconductor frame 31A and the pressing members 260 press the prism-shaped protrusions 261 protruding from the side surface of the developing frame 33A, but the invention is not limited to the configuration. For example, the pressing members may be disposed at the developing frame 33A and the developing frame 33A is pushed to the photoconductive drum 32 by allowing the pressing members to press the photoconductor frame 31A. Pressing members pressing the developing frame 33A to the photoconductive drum 32 may be disposed at the main casing 2.

In the embodiments, the developer cartridge 33 having the developing roller 36 is an example of the cartridge of the invention, but the invention is not limited to it. That is, a process cartridge having a photoconductive drum in addition to the developing roller or a toner cartridge having at least a toner hopper may be used as the cartridge of the invention.

Figure 14:
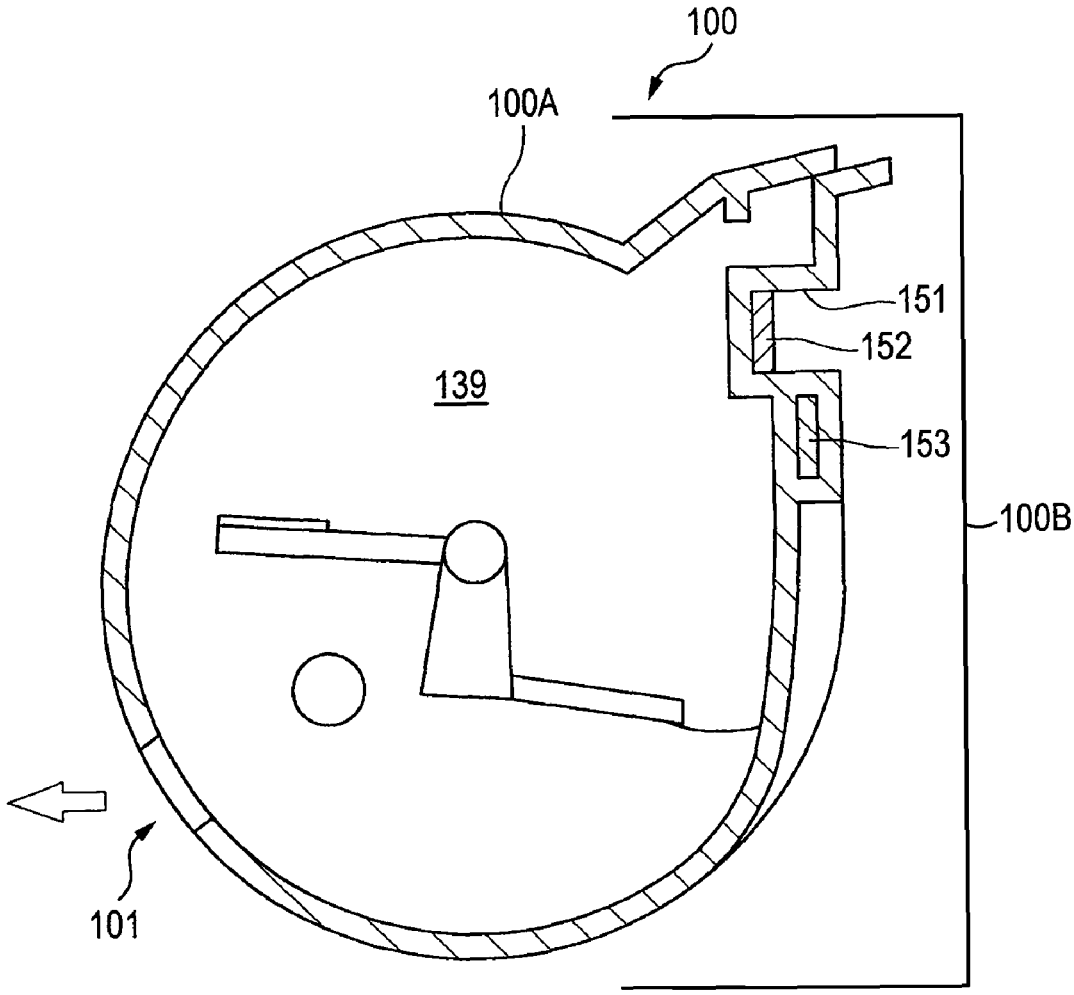
FIG. 14 is a side cross-sectional view illustrating a cartridge according to another embodiment of the invention.

Here, the toner cartridge 100 shown in FIG. 14 can be used as the toner cartridge. FIG. 14 is a side cross-sectional view illustrating a cartridge according to another embodiment of the invention.

The toner cartridge 100 includes a toner hopper 139 as an example of the developer container containing a toner, a cartridge frame 100A having an opening 101 for supplying the toner for a developing process, and an IC chip 153 as an example of the memory unit. A grip portion 100B which is gripped by a user at the time of attaching and detaching the toner cartridge 100 is formed in a part of an end of the cartridge frame 100A opposite to the opening 101 with the toner hopper 139 interposed therebetween. A concave portion 151 is formed in the grip portion 100B and a memory terminal 152 electrically connected to the IC chip 153 is disposed on the bottom of the concave portion 151.

According to the toner cartridge 100 having the above-mentioned configuration, the following advantages can be obtained.

According to the toner cartridge 100, by allowing the concave portion 151 to normally engage with the main-body engaging portion, it is possible to electrically connect the memory terminal 152 to the main-body terminal. Accordingly, it is possible to accomplish the electrical connection between the IC chip 153 and the controller 6 disposed in the image forming device with a simple structure.

According to the toner cartridge 100, even when a toner cartridge (not shown) having a concave portion not engaging with the main-body engaging portion is attached to the image forming device and the front cover (see FIG. 8) is closed, the memory terminal 152 does not come in contact with the main-body terminal. Accordingly, for example, the image forming device 1 outputs an error or does not work and thus a user can find out the failure of the image forming device, thereby easily finding out the attachment of the erroneous cartridge to the image forming device.

According to the toner cartridge 100, since the memory terminal 152 is disposed on the bottom of the concave portion 151, it is possible to suppress a damage of the memory terminal 152 due to an interference with another member of the image forming device or a damage due to a user's erroneous handling at the time of attachment.

It is preferable that the memory terminal 152 is disposed at the center in the width direction of the cartridge frame 100A (see FIG. 11). Accordingly, it is possible to reduce an influence on the uniform pressing between the developing roller and the photoconductive drum. The same advantage can be accomplished by disposing the memory terminals 152 symmetrically with respect to the center position in the width direction of the cartridge frame 100A (see FIG. 13).

Here, the "width direction of the cartridge frame 100A" means a direction (a direction perpendicular to the sheet surface of FIG. 14 and parallel to the axis direction of the developing roller 36) horizontally perpendicular to the toner supply direction (the arrow direction in FIG. 14).

What is claimed is:

1. An image forming device comprising:
- a main body including a controller and a door having an open state and a closed state;
- a photoconductive drum;
- a developer cartridge configured to be housed in the main body, the developer cartridge including:
  - a developing roller facing the photoconductive drum;
  - a developer container configured to contain a developer;
  - a memory unit; and
  - a first terminal electrically connected to the memory unit;
- an urging member disposed on the door, the urging member configured to impart an urging force to the developer cartridge when the door is in the closed state and the developer cartridge is housed in the main body; and
- a second terminal disposed on the urging member and electrically connected to the controller, the second terminal configured to contact the first terminal when the door is in the closed state.

2. The image forming device according to claim 1,
wherein the urging member is configured to urge the developing roller against the photoconductive drum.

3. The image forming device according to claim 1,
wherein the developer cartridge includes an exterior surface, and
wherein the first terminal is located on a portion of the exterior surface opposite from the developing roller.

4. The image forming device according to claim 1, wherein the developer cartridge includes an exterior surface and a recess formed in the exterior surface, and
wherein the first terminal is located in the recess.

5. The image forming device according to claim 1, wherein the recess includes four walls.

6. The image forming device according to claim 1, wherein the developer cartridge includes a grip portion.

7. An image forming device configured to house a developer cartridge having a first terminal connected to a memory, the image forming device comprising:
- a main body including a controller and a door having an open state and a closed state;
- an urging member disposed on the door, the urging member configured to impart an urging force to the developer cartridge when the door is in the closed state and the developer cartridge is housed in the main body; and
- a second terminal disposed on the urging member and electrically connected to the controller, the second terminal configured to contact the first terminal when the door is in the closed state.

8. The image forming device according to claim 7, wherein the image forming device is configured to receive a photoconductive cartridge.

9. The image forming device according to claim 8,
wherein the urging member is configured to urge the developer cartridge against the photoconductive cartridge.

10. The image forming device according to claim 7,
wherein the developer cartridge includes an exterior surface, and
wherein the first terminal is located on a portion of the exterior surface opposite from the developing roller.

11. A developer cartridge configured to be housed in a main body having a controller and an openable/closeable door with an urging member and a terminal on the urging member, the developer cartridge comprising:
- an exterior surface;
- a developing roller;
- a developer container configured to contain a developer;
- a memory unit; and
- a first terminal located on a portion of the exterior surface opposite from the developing roller, the first terminal configured to be electrically connected to the memory unit, and the first terminal being located to contact the terminal of the urging member on the door when closed.

12. The developer cartridge according to claim 11,
wherein exterior surface includes a recess, and
wherein the first terminal is located in the recess.

13. The developer cartridge according to claim 12,
wherein the recess includes four walls.

14. The developer cartridge according to claim 11,
wherein the developer cartridge includes a grip portion.

15. The developer cartridge according to claim 11,
wherein the first terminal is located to receive an urging force from the urging member when the door is closed.

16. The developer cartridge according to claim 15,
wherein the urging force received at the first terminal is in a direction that urges the developing roller toward a photoconductive drum.

* * * * *